US006509883B1

(12) United States Patent
Foti et al.

(10) Patent No.: US 6,509,883 B1
(45) Date of Patent: Jan. 21, 2003

(54) SIGNAL COUPLING METHODS AND ARRANGEMENTS

(75) Inventors: Stephen Foti, Tenterden (GB); Joseph Parkinson, Maidstone (GB)

(73) Assignee: Racal Antennas Limited, Berkshire (GB)

( * ) Notice: Subject to any disclaimer, the term of this patent is extended or adjusted under 35 U.S.C. 154(b) by 0 days.

(21) Appl. No.: 09/719,550

(22) PCT Filed: Jun. 25, 1999

(86) PCT No.: PCT/GB99/02006

§ 371 (c)(1),
(2), (4) Date: Mar. 2, 2001

(87) PCT Pub. No.: WO00/01030

PCT Pub. Date: Jan. 6, 2000

(30) Foreign Application Priority Data

Jun. 26, 1998 (GB) ..... 9813913
Jun. 26, 1998 (GB) ..... 9813914

(51) Int. Cl.[7] ..... H01Q 1/50
(52) U.S. Cl. ..... 343/850; 343/852; 455/63
(58) Field of Search ..... 343/850, 852, 343/853, 857, 858, 865, 700 MS; 455/63, 67.3, 69, 72, 304, 303; H01Q 1/50

(56) References Cited

U.S. PATENT DOCUMENTS 4,419,635 A 12/1983 Reindel ..... 333/116
4,728,960 A * 3/1988 Lo ..... 343/700 MS
4,903,033 A 2/1990 Tsao et al. ..... 343/700 MS
4,952,193 A * 8/1990 Talwar ..... 455/63
5,017,931 A * 5/1991 Carlyon ..... 33/700 MS
5,117,505 A * 5/1992 Talwar ..... 455/278.1
5,125,108 A * 6/1992 Talwar ..... 455/278.1
5,264,862 A * 11/1993 Kumpfbeck ..... 343/853
5,832,389 A * 11/1998 Dent ..... 455/562
6,222,498 B1 * 4/2001 Ishii et al. ..... 343/853

FOREIGN PATENT DOCUMENTS

DK 4305 908 A1 9/1994
EP 0 271 458 A 6/1988
EP 0 847 101 A2 6/1998
FR 2 616 015 12/1988
GB 0808030 A2 * 11/1997 ..... H04B/1/12
GB 2326799 A2 * 12/1998 ..... H04B/1/48

OTHER PUBLICATIONS

Electronics Letters, M. Edimo et al., "Optimised Feeding of Dual Polarised Broadband Aperture–Coupled Printed Antenna", vol. 28, No. 19, Sep. 10, 1992, pp. 1785–1787, XP000319097.

B. Lindmark et al., "Dual–Polarized Array For Signal–Processing Applications In Wireless Communications", IEEE Transactions on Antennas and Propagation, vol. 46, No. 6, Jun. 1, 1998, pp. 758–763, XP000766084.

* cited by examiner

*Primary Examiner*—David Vu
*Assistant Examiner*—Trinh Vo Dinh
(74) *Attorney, Agent, or Firm*—Oblon, Spivak, McClelland, Maier & Neustadt, P.C.

(57) ABSTRACT

Signal coupling arrangements are described in which the effect of unwanted signals transferred between two antennas is compensated for. In one arrangement, a microstrip edge coupler is used as a compensation network to provide a cross-coupling path for the transfer of a compensating signal between two antenna signal paths. In another arrangement, an antenna assembly includes cross-slots which, in association with a conductive ring, provide two mutually orthogonally polarized radiation signals and connections to the conductive ring have closed spaced portions which provide compensation for and minimize the effect of unwanted mutual coupling.

11 Claims, 4 Drawing Sheets

SIGNAL COUPLING METHODS AND ARRANGEMENTS

Figure 1:
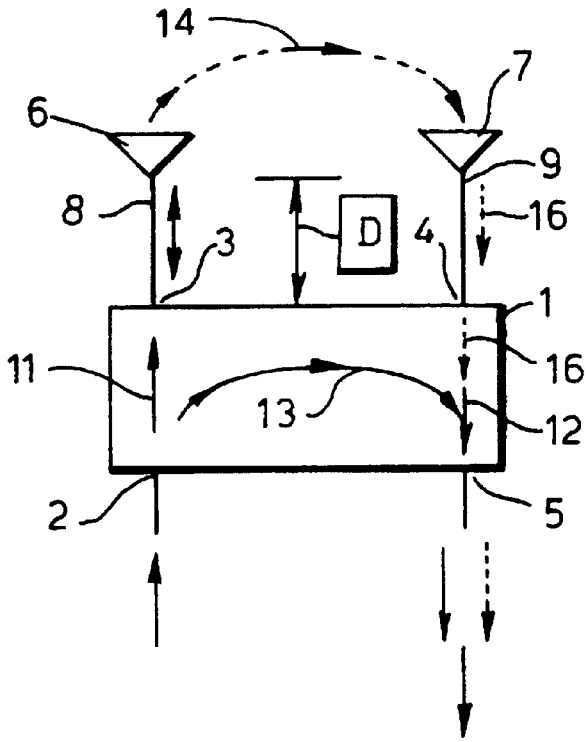

This invention relates to signal coupling methods and arrangements which are particularly, though not exclusively, applicable to the coupling of signals to and from antennas.

One arrangement to be described below, by way of example in illustration of the invention, which is directed to minimising the effect of unwanted coupling between electrical circuits, has a four-port coupling network which has two main signal paths and which provides connection between two antennas and their respective associated equipment. The four-port coupling network also has an auxiliary path which provides a degree of coupling between one of the two main signal paths and the other. A characteristic of the cross-coupling is such that a proportion and quality of the signal in the one of the main signal paths is passed to the other path, according to the need to provide compensation for unwanted coupling between the antennas, and it can be adjusted to meet this need. Between the coupling network and each of the two antennas there is a respective antenna signal path and the electrical length of each of these paths may be so arranged that the signal which is deliberately cross-coupled between the signal paths is in anti-phase with an unwanted signal which has been transferred from one antenna to the other due to mutual coupling. The anti-phase property is provided, in general, by the appropriate choice of the lengths of the paths between the four port coupling network and each of the antennas. The proportion of the signal which is deliberately cross-coupled between the one main signal path and the other in order to effect the compensation is ideally selected or selectable to be of the same magnitude as the unwanted signal which has been derived from mutual coupling between the antennas, at the position at which the compensating cross-coupling occurs. In this way the effect of the unwanted coupling is minimised. There need not be a discrete or clearly defined device having four ports. It is possible to employ equipment which performs the same function. It is also possible to provide phase compensation by adjusting the phase of the deliberate cross coupled signal, either instead of, or in addition to the compensation provided by the lengths of the paths connecting the antennas to the coupling network.

A second arrangement to be described below, by way of example in illustration of the invention, is directed to the provision of a coupling which has a comparatively small profile, and which operates with a comparatively wide bandwidth with good performance, including at microwave frequencies.

A feature of the second arrangement is that it has a printed ring shaped conductor which is coupled to two signal ports at points which are approximately 90° apart on the conductor ring. The ring conductor is coupled to a printed cross-slot conductor pattern which, during operation develops across the respective slots, two electromagnetic fields at two mutually orthogonal polarisations. The use of a cross-slot pattern to match a patch antenna has previously been proposed, for instance by Edimo et al in Electronics Letters, 10 Sep. 1992, Vol. 28, No. 19, but there was no suggestion that a circular ring-shaped or other shaped loop conductor should be used to provide the coupling with the cross slots. Since the two signal input ports excite orthogonal radiation modes, there is little or negligible interaction between them.

In particular arrangements to be described below, by way of example, in illustration of the invention, crossed slot fields excite 'fringing' electromagnetic fields around the edge of a metal patch, from which when the antenna is transmitting they radiate as two separate, but substantially coincident, conically shaped propagation patterns. The patch is not essential to the operation of the embodiments, but it results in the provision of more concentrated beams, i.e. beams having a narrower angle of propagation than they would otherwise have. Other parasitic elements may be used to provide other shapes of propagation pattern. On the other hand it is possible to employ embodiments having no parasitic element, such as a patch.

It is also possible to employ a reflector plate in order to confine the beams to one general direction of propagation. On the other hand, should propagation in two opposite directions be required, or not be objectionable, it is possible to omit a reflector plate.

Figure 2:
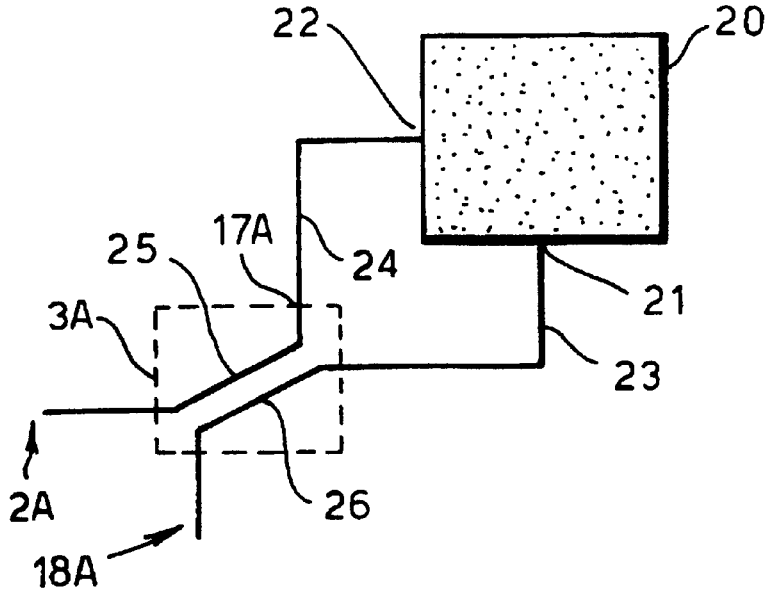
Figure 3:
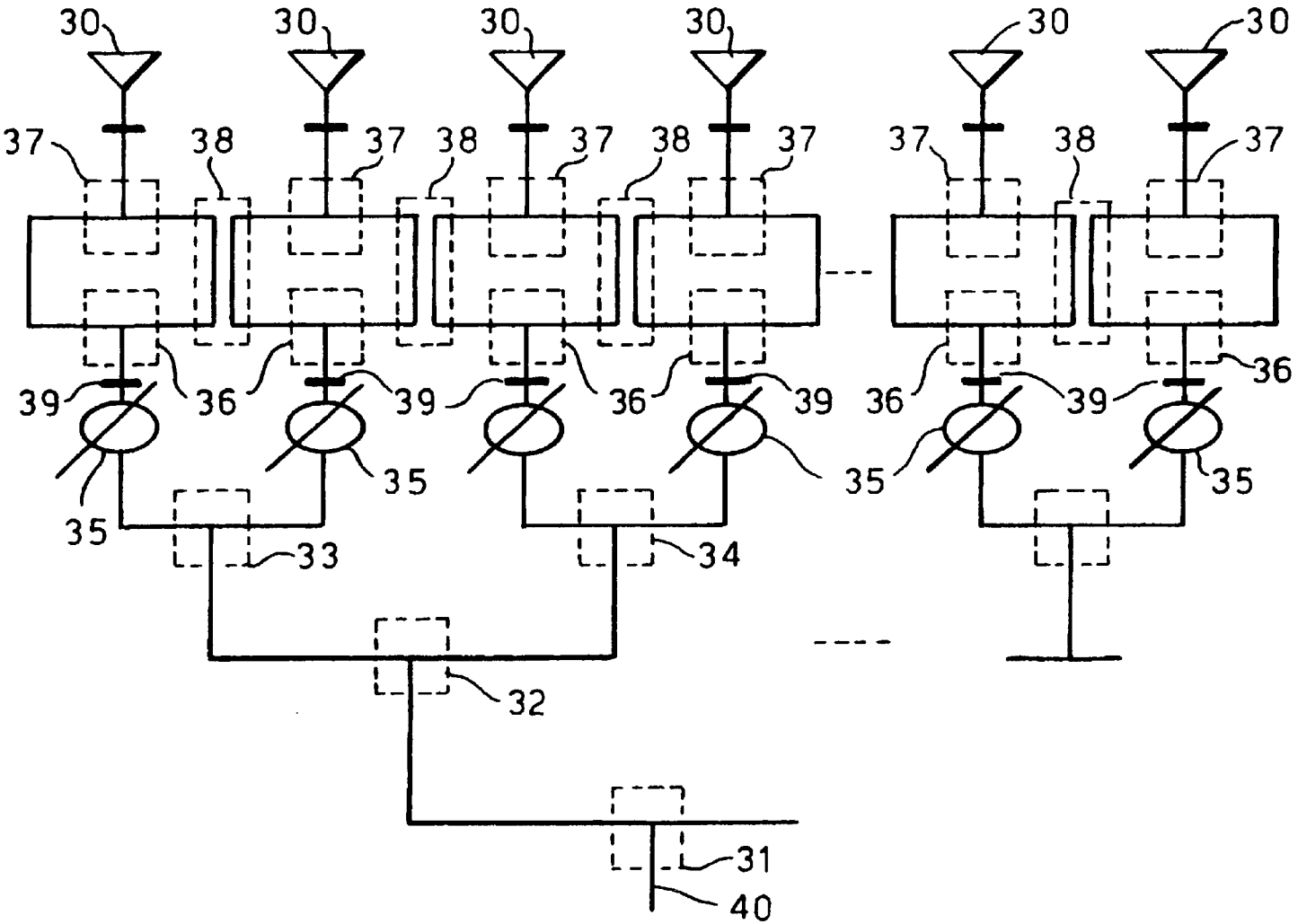
Figure 4:
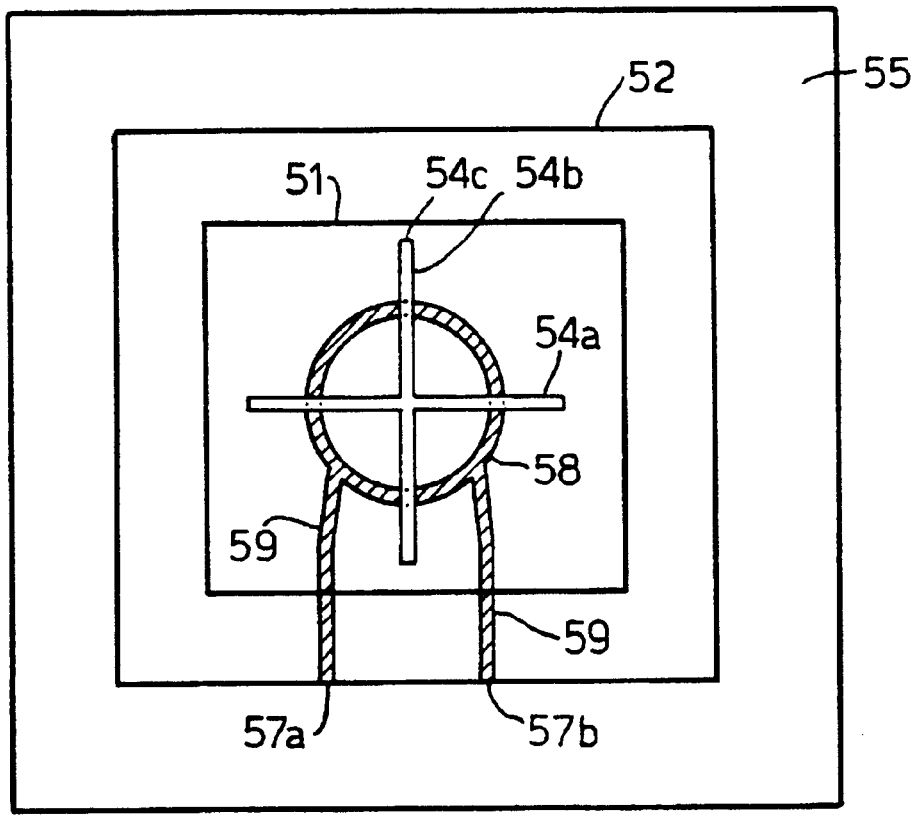
Figure 5:
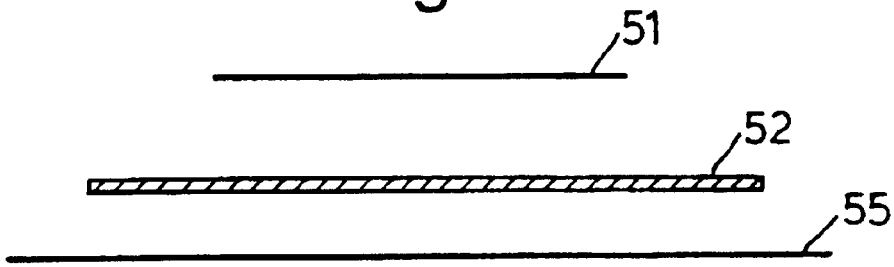
Figure 6:
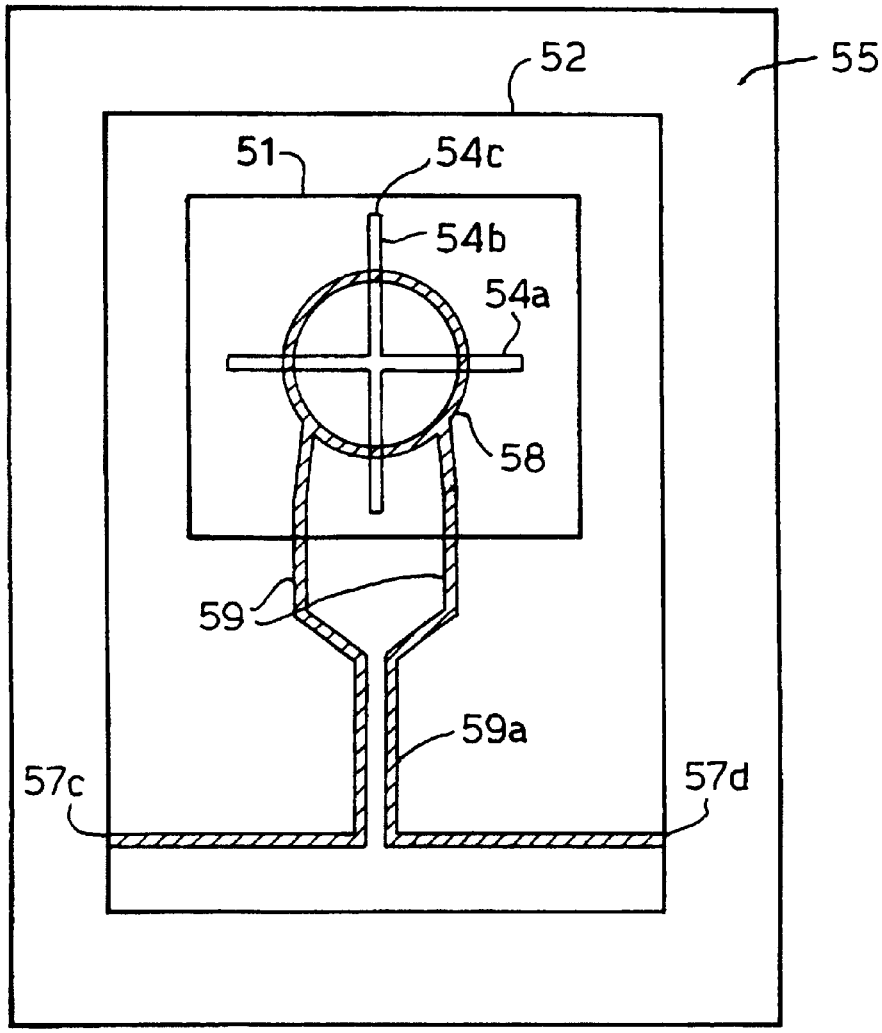
Figure 7:
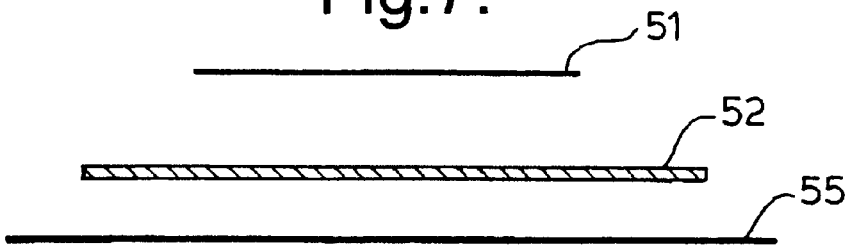

Arrangements illustrative of the one arrangement described above and illustrative of the invention will now be described, by way of example, with reference to FIGS. 1 to 3 of the accompanying drawings and arrangements illustrative of the second arrangement described above and illustrative of the invention will now be described, by way of example with reference to FIGS. 4 to 7 of the accompanying drawings in which:

FIG. 1 is a block schematic diagram for use in describing the one arrangement, FIG. 2 illustrates diagrammatically a patch dual-polarised antenna, FIG. 3 is a block schematic diagram showing a phased antenna array, FIGS. 4 and 5 show respectively diagrammatic plan and side views of components of a first antenna, and FIGS. 6 and 7 show respectively diagrammatic plan and side views of components of a second antenna.

Referring to FIG. 1 there is shown a four port coupling network 1 having ports 2, 3, 4 and 5. Port 3 is connected from the network to an antenna 6 via a path 8 and the port 4 is connected to an antenna 7 via a path 9. Main signal paths 11 and 12 are provided in the network 1 between the pair of ports 2 and 3 and the pair of ports 4 and 5 respectively. Between the signal paths 11 and 12 there is a cross-coupling path 13 for the transfer of a compensating signal.

During the operation of the arrangement, a part of the signal which has been input at port 2, then passed via signal path 11 in the network 1 to the port 3, and fed via the coupling path 8 to the antenna 6, from which it is radiated, reaches the other antenna 7 via a path indicated diagrammatically at 14 and representing the mutual coupling. This signal which is received by the antenna 7 via the path 14 is unwanted and may cause interference. However, it is then passed, as indicated by dotted lines 16, with any wanted signal received by the antenna 7, via the coupling path 9, and the port 4 to the main signal path 12 in the network 1.

The main signal path 12 also receives a compensating signal from the path 11 via the cross-coupling path 13. The cross-coupling path 13 has characteristics such that the compensating signal which reaches the path 12 via the path 13 is of the same magnitude, but of opposite phase, to the unwanted signal which reaches the signal path 12 from the antenna 7 via the port 4, with the result that the compensating signal effectively cancels out the unwanted signal.

It is possible to arrange that the compensating signal is of the same magnitude as, but opposite phase to, the unwanted signal which reaches the signal path 12 by adjusting the characteristics of the cross-coupling path 13, of one or both of the signal coupling paths 8 or 9, or of other elements, or combinations of elements, which affect the characteristics of the signals which are to be brought into the required relationship.

For example, the lengths of the signal paths 8 and 9 between the transmission antenna 6 and the port 3 and between the receiving antenna 7 and the port 4 may have an equal value D, as indicated in FIG. 1, so that the compensating signal received at the path 12 via the cross-coupling path 13 and the unwanted signal received by the antenna 7 and fed to the path 12 are in antiphase in the path 12 and therefore substantially cancel one another out at the port 5.

The relative lengths of the signal paths undergone by the compensating and unwanted signals is calculated or measured by taking into account the effective length of the signal compensation path 13 undergone by the compensating signal between the main paths 11 and 12 on the one hand, and on the other hand, by the combined lengths of paths which extend from the port 2, via the paths 11, 8, 14, 9 and 12 to the port 5. Since the lengths of paths 8 and 9 amount to 2D, the selection of D is a convenient way to select the path difference between the compensating signal and the unwanted signal to be one half of a wavelength or an odd number of half wavelengths.

The wanted signals which are received by the receiving antenna 7 thus appear at the port 5 with a minimum of interference from any unwanted signal that has been received by the antenna 7 via the path 14.

The two antenna elements 6 and 7 shown in FIG. 1 may be identical elements employing the same polarisation, be nominally orthogonal elements with nominally orthogonal polarisation, or be completely different elements with arbitrary polarisation properties.

Referring now to FIG. 2, there is shown a dual polarised microstrip patch antenna 20 wherein the two 'elements' 6 and 7 of FIG. 1 are provided in a single patch antenna structure. Two antenna ports 21 and 22, which are shown providing connection points to the two elements 6 and 7. The elements 6 and 7 nominally 'excite' or are "excited" by horizontal and vertical polarisations of signal 1. Were the structure to be physically rotated, say by 45°, then the nominal polarisations would be +slant 45° and −slant 45° respectively. In such a dual polarised antenna, for example one may wish to connect a transmitter to the vertically polarised port 21 and a receiver to the horizontally polarised port 22. In order that the transmitter should not interfere with the receiver operation, high isolation (low mutual coupling) is, as mentioned above, required between the two antenna "elements" 6 and 7 of the patch antenna 20. However, where coupling exists, the employment of a four port compensation network along the lines of the network 1 described with reference to FIG. 1 may be employed. A suitable cross-coupling compensation arrangement is shown at 3A in FIG. 2. The arrangement shown at 3A employs a microstrip edge coupler network connected through transmission lines 23, 24 which are of the optimum length to provide substantial cross-coupling cancellation of the inherent mutual coupling between the antenna elements 6 and 7 and thus results in an apparent effective degree of the desired high isolation.

In more detail, the network 3A has two ports 2A and 17A connected by a first microstrip path 25, and two further ports 16A and 18A connected by a second microstrip path 26. The two paths 25 and 26 are edge coupled, in a known way, to provide a predetermined amount of backward compensating cross-coupling achieved as a result of the inherent backward-wave coupling of the edge coupler device. The four ports and cross-coupled paths of the network 3A are analogous, in function, to the network 1 described with reference to FIG. 1.

The antenna ports 21 and 22 are connected respectively by paths 23, 24 to ports 16A, 17A of the network 3, such that an odd number of half wavelengths of phase difference is exhibited between the "mutual coupling" path between the antennas and the transmission line paths back through the network 3A, taking the inherent quadrature phase relationship between the input signal and the edge coupled backward wave into account. The signal which is cross-coupled between the paths 25 and 26 then tends to cancel the mutual coupling which is inherent, but unwanted between the two "elements", i.e. the two nominally orthogonal polarized signals of the patch antenna 20. The appropriate value for the lengths of the paths 23, 24, which correspond approximately to the paths 8 and 9, each of length D, shown in FIG. 1, and/or for the backward coupling factor of the microstrip edge coupler 25/26 towards the port 18A, can be established by preliminary experiment or by theoretical calculations.

Referring now to FIG. 3, there is shown an arrangement which incorporates a multiplicity of coupling networks employing the same general principles as those described with reference to FIG. 1, in that mutual coupling is reduced or cancelled by employing the cross-coupling of a compensating wave in anti-phase to an unwanted received signal. A multi-element antenna array system serves for the transmission of composite signals which are effectively controlled in the direction of their propagation by the control of their relative phases to each antenna element. A phased array antenna system, as depicted diagrammatically in FIG. 3, is a composite antenna composed of a multiplicity of similar elements 30 all excited through a distribution network typically utilising two- or multi-way signal splitter devices 31–34 and phase shifter devices 35 which, as is well known, are able electronically to adjust the amount of the signal phase shift for each element. Such control of the phase shifts facilitates the electronic beam steering of the array antenna. If only one fixed beam steering position were to be desired, so that the phase distribution, i.e. the relative phase shifts, were constant, then, even though mutual coupling would affect the so-called "active" impedance of each element, this impedance effect can be 'tuned-out' by appropriate impedance matching networks. However, if the beam is electronically steered by varying the relative phases between neighboring antennas, the phase of the mutually coupled signals will vary dependent upon the specific beam steering command, and such an effect cannot be tuned-out by the use of simple fixed impedance matching networks. This effect, in turn, causes interaction between the elements which typically gives rise to a degraded radiation pattern shape (high sidelobes, for example) and a reduction in antenna gain. In fact in the extreme case, an effect known as 'array blindness' can arise in which no useful beam is formed for a particular beam steering angle command. This occurs when all of the mutual coupled signals cancel with the input signals to each element, resulting, in effect, in total reflection. Hence, cancellation, or at least a reduction in mutual coupling, as provided for by the arrangements described above is desirable, so that any degradation of the performance of the array is minimised, as the beam is electronically steered to different directions. The arrangement being described cancels the mutual coupling between adjacent elements.

In more specific detail, the antenna array elements 30 shown in FIG. 3 may be all identical and be fed with a proportion of the signal applied to an input 40. That signal is split into a multiplicity of signal components, for example using a number of two-way splitters such that there are as many signal components as there are antenna elements 30 to be energized.

The signal components are fed through respective phase shifters 35 which are adjusted, or preset, to the successively staggered relative phase shifts required to cause the array of antennas 30 to direct an effective recombined beam a predictable number of degrees or radians to the right or left, as desired.

After leaving the beam steering phase shifters 35, the signals are again each split two ways at a respective splitter 36, and these latter two signals are recombined at splitters 37 connected in reverse, so that the signals are combined for feeding to the respective antenna 30. Before reaching the stage of the combiners 37 there are two signals for each antenna 30. At each antenna one or both of these two signals undergoes a degree of auxiliary cross-coupling from the signal feed to the next antenna through a cross-coupling circuit 38, which may again be realized as an edge coupler, and be provided to develop a compensating cross-coupled signal. The auxiliary cross-coupled signals may have different phases due to the staggering of the settings of the phase-shifters 35 from one end to the other of the array, but the amount will "track" the phase of the mutually coupled signals to maintain coupling cancellation as the beam is steered.

The previously described arrangements of FIGS. 1 and 2 showed a transmitting antenna radiating unwantedly to a neighboring receiving antenna. In fact, these antennas could have both been transmitting and receiving simultaneously. The phased array antenna arrangement of FIG. 3 is different, in that there are more than two antennas, the total array either transmitting or receiving. However, the problem is similar, in so far as each antenna tends to radiate to its neighbor, to some degree, which is often prejudicial. It is considered for the purposes of the present example, that only mutual coupling between neighboring antennas 30 is of sufficient magnitude to be prejudicial—i.e. the coupling between all non-adjacent antenna pairs can be ignored without serious effects.

As in the previously described arrangements, each antenna element 30 is considered to receive an undesirable proportion of the signal radiated from its immediately adjacent antenna or antenna elements 30. This is even true in a reciprocal manner when the antenna array is used for receiving signals, owing to the well-known Lorentz reciprocity theorem from electromagnetic theory.

The undesirable mutually coupled signal will be conducted back at least to the point 39 between the phase-shifter 35 and the splitter 36, which point may be designated an augmented antenna port 39. The cross-coupler 38 is designed to provide a compensating cross-coupled signal which reaches point 39 with the same amplitude as, but of opposite phase to, the undesirable mutually coupled signal arriving at point 39. As described above with reference to FIG. 1, the opposite phase relationship may be achieved by appropriately selecting the path length between each combiner 37 and its respective antenna 30. This is analogous to the selection of the path length D in the FIG. 1 embodiment in order to bring about an anti-phase condition between a mutually coupled undesirable signal and a compensating auxiliary cross-coupled signal.

The auxiliary path coupling factor of the cross-coupler 38 and the path length between the feeds to the individual combiners 37, and/or between the feeds to the neighboring antennas 30, provides a predictable compensation to cancel out, or at least to reduce, the unwanted and accidental mutual coupling signals between neighboring antennas 30.

This embodiment differs from those of FIGS. 1 and 2 in that there are no orthogonal polarizations or other diversities between the antennas, merely phase differences and differential or relative path lengths, and predictable auxiliary compensating cross-coupling factors of devices 38.

It will also be noted that the antennas 30 which are not at the two ends of the arrays will be coupling unwanted signals to two neighboring antennas, and two compensating auxiliary coupling signals are likewise injected via two respective cross-coupling edge, or other couplers 38, from the two neighboring antenna feeds.

Referring still to FIG. 3, it may be seen that, by including a multiplicity of two-way splitters working in conjunction with the cancellation networks, a set of augmented antenna element ports 39 is provided, each of the ports being highly isolated as a result of the use of the arrangement described. The phase shifters 35 are connected to these augmented ports. Now, the control of the phase shifters for electronic beam steering will facilitate the performance of the antenna array, which does not suffer from the effects of mutual coupling discussed above; even when different beam angles are steered, these effects being greatly reduced without retuning the impedance matching networks.

In summary, there have been described signal transmitter or receiver equipment, including a transmitter or receiver antenna and a further antenna, main signal paths conveniently of an optimum length (D) connecting the two antennas with functional components of the equipments and a compensating cross-coupler coupled to provide an auxiliary compensating path between the two main paths, such that the effect of mutual coupling between the two antennas is at least partially compensated. The further antenna may be a receiver antenna, and the compensating cross-coupler defines an auxiliary path which couples power from the main path feeding signals to the transmitter antenna to the other main path feeding signals from the receiving antenna. Other means such as orthogonal polarization diversity may accompany the isolation produced by the cross-coupling. An optimum path length (e.g. D) may be chosen between the antennas and either the adjacent ports of the compensating cross-coupler, or combiners at the ports. The two antennas may be a single patch antenna or other dual-polarised antenna element, which provides operation at orthogonal polarizations when fed from appropriate points. The compensating cross-coupler may then for example, be a microstrip edge coupler connected to the appropriate points by different lengths of microstrip path. The two antennas may be part of an antenna array, in which all antennas are either transmitting antennas or receiving antennas arranged to produce a composite beam, the antennas being fed via differently selected or variable phase shifters and signal splitters and combiners, such that the beam direction is selected or variable, and every adjacent pair of antennas of the array being equipped with a compensating cross-coupler which provides an auxiliary path between the main feed paths of each pair the various feed-path lengths being chosen to bring about an effective cancellation of, or substantial reduction in, unwanted mutually coupled signals at augmented antenna ports (39), being points on opposite sides of the cross-couplers from the actual antenna ports.

Referring to FIGS. 4 and 5, there are shown a square metal patch radiating element 51 and a reflector plate 55.

Between the patch element 51 and the reflector plate 55 there is a printed circuit board (pcb) 52. On one side of the printed circuit board 52, there is a metallised pattern in the shape of a ring 58 from which there extend two legs 59 which terminate in respective ports 57*a* and 57*b* at an edge of the board 52.

The legs 59 provide a coupling for signals passing to and from the ring 58 and the ports 57*a* and 57*b*, and the legs 59 are connected to the ring 58 at points which are nominally physically 90° apart around the ring 58. The nominal 90° spacing between the points of connection of the legs 59 to the ring 58 is related to the frequency at which the antenna is intended to operate. Having regard to the dielectric material of the printed circuit board 52, the nominal length of the loop of the ring is designed to constitute one wavelength of the operating frequency of the antenna. With this arrangement, any coupling between the connection points on the ring 58 to the legs 59, and thus between the ports 57*a* and 57*b*, is minimised because the two signal paths in opposite directions around the ring between the connection points effectively differ by one half a wavelength of the signal, and signals reaching each of the respective connection points after travelling in the opposite directions will be of equal and opposite polarity.

Although in the particular arrangement being described, where the preferred transmitting or receiving radiation pattern associated with the antenna is along an axis perpendicular to the plane of the ring, the length of the ring 58 is nominally equal to one wavelength of the signal, it is possible where, for example, other radiation patterns are required for the circular length of the ring 58 to be a multiple of the nominal signal wavelength. It is also possible for the ring 58 to be of some other shape than circular, for example, it may be square, or oval, or even follow an irregular shape, according to the antenna sensitivity or the radiation pattern required.

On the other side of the printed circuit board 52 from the ring 58, there is a conductive sheet having two slots 54*a* and 54*b* therein. The slots 54*a* and 54*b* cross one another at 90°, and have a common centre which is aligned with the centre of the ring 58. One arm of the slot 54*a* coincides with a point on the ring 58 which is angularly mid-way between the connection points on the ring 58 of the legs 59.

The connections between the ring 58 and the ports 57*a* and 57*b* are thus at points on the ring 58 which are respectively nominally spaced from the apparent point of coincidence of the one arm of the slot 54*a* with the ring 58 by angles of +45°.

The slots 54*a* and 54*b*, which are each nominally one half wavelength in length at the operating frequency in the embodiment being described, extend to points which are beyond and outside the projection on them of the ring 58. As a result, two fields of resonance, which are exited in the slots 54*a* and 54*b*, together with the fields associated with the ring conductor 58 create a pattern of sensitivity or radiation which extends in a cone shape outwardly around the edges of the patch 51, where such a patch is provided.

On the other side of the printed circuit board 52 from the radiating plate 51, there is a reflector plate 55 which extends beyond the projections of the other components of the antenna. Although the use of such a reflector is preferred in the embodiment being described, it is not essential. The reflector 55 need not be flat, it may have upstanding side walls, or be dish shaped. Its effect is either to make the antenna more sensitive to radiations received by the antenna components 51 and 52, or to restrict the emission of radiations from these components to directions away from the reflector.

Advantages of the structure which has been described with reference to FIGS. 4 and 5 are that it is capable of operation over a wide bandwidth, is compact, and has a comparatively small edge to edge dimension so that it has a relatively small profile when in use.

Since the excitation of the antenna described above is symmetrical, the resulting patterns for the two orthogonal polarisations will be nominally identical giving good tracking between the signals from the two ports 57*a*, 57*b*. Previous proposals having similar objects, such as those featured in the specification of the European patent application published under No. 605338 on Jul. 6, 1994, do not have this feature of symmetry, so that the patterns are not similar, and the antenna pattern tracking is inferior.

The particular arrangement described above utilizes only one substrate layer for the connections to the feed ports 57*a*, 57*b*, which simplifies the production of the antenna, as well as simplifying the electrical symmetry. The proposed construction discussed in the Electronics Letters reference mentioned above employed an insulating layer to separate two orthogonal microstrip lines, which would make the volume manufacture of the antenna proposed in that publication more difficult.

The antenna which has been described above with reference to FIGS. 4 and 5 may be used without the patch 51 (for broader beam width) and also without the rear reflector 55 (for bidirectional operation). Also the patch 51 may be adjacent the slots 54*a* and 54*b*; and/or the reflector 55 may be on the other side of the printed circuit board 52 from that shown.

Referring to FIGS. 6 and 7, there is shown a slightly different conductor track geometry, which also follows a symmetrical pattern although there are differences in the arrangements of ports 57*c* and 57*d* compared with the ports 57*a* and 57*b* shown in FIGS. 4 and 5. Apart from the difference that the ports 57*c* and 57*d* are on opposite edges of the printed circuit board 52 there is the difference that the ports 57*c* and 57*d* are connected to the ring 58 via an edge coupled microstrip, indicated at 59*a* by closely spaced lengths of the two legs 59, so arranged that residual mutual coupling, particularly between the antenna ports 57*c* and 57*d*, can be minimised. This arrangement for minimising the effect of mutual coupling is the subject of the description of FIGS. 1 to 3 above.

The dielectric between the elements of the antenna may be other than the material of the printed circuit board 52, for example, it may be air, and the ring 58 may be spaced from the slots 54*a* and 54*b* in some other way. It will be appreciated that the dimensions of the components of the antenna will depend not only upon the frequency of operation but also upon the characteristics of the components, including that of the dielectric.

In summary, there have been described above antenna arrangements which operate at two mutually orthogonal polarisations, and which have two input ports, respective feed paths from the ports to two spaced points on a conductive ring, a pair of cross slots in a conductive sheet located in a plane spaced from that of the conductive ring and centralized with respect to it, such that two coincident radiation paths at crossed polarisations are created generally along an axis perpendicular to the plane of the ring, in one or both directions, and wherein the spaced points on the ring, the ring itself and the slots are so located and dimensioned, that a higher degree of isolation is achieved between the two radiation signals of orthogonal polarisation, than the isolation provided by virtue of their orthogonal polarisation alone. There may be a patch plate or other parasitic radiating element arranged about the axis which is normal to the plane of the ring. The spaced points on the ring 58 may each be at a respective point which is nominally 45° around the ring in a direction opposite to that of the other relative to one of the two slots, according to the frequency of operation, and having regard to the particular dielectric employed. The circumference of the ring 58 in the examples is nominally one wavelength of the operating frequency.

The slots 54*a*, 54*b* are nominally one half wavelength in length at the operating frequency and they cross at their mid points perpendicularly to each other. Other slot geometries are possible. For example, each main slot may have a slot at each of its ends which is perpendicular to the main slot, thereby forming T-junctions at the ends of the main slot. The conductive ring 58 and/or the slots 54*a*, 54*b* may be applied to opposite surfaces of the printed circuit board 52. A conductive rear reflector or reflecting cavity 55 may be located on the opposite side of the printed circuit board 52 from a patch plate 51. The cross slots 54*a*, 54*b* may be voids in a conductive sheet printed on the surface of the printed circuit board 52 facing the rear reflector 55, or on the surface remote from the reflector.

An edge coupler may be provided over chosen lengths of the feed paths or legs 59, to couple between microstrip feed paths 59*a* for improved isolation.

It will be understood that although particular arrangements, illustrative of the invention have been described, by way of example, variations and modifications thereof, as well as other arrangements employing the invention may be made.

For example, the ring 58 which has been described has a physical length of either one wavelength or a multiple thereof at the operating frequency, and feed connections, are provided which are separated by 90° in one direction and 270° in the other direction around the ring, in order to provide signals at the connection points which cancel or are at null points. It will be understood that by making the ring 58 of a different relative length compared to the operating frequency, feed points may be chosen at different angular positions than those described in order to provide a similar effect. For example the length of the ring 58 may be $\lambda/2$.

It has been explained that the geometry of the ring 58 may be other than circular, for example square, or oval, or even have an irregular meandering shape. It is also possible for the ring 58 not to be physically continuous. For example, there may be a physical interruption in the length of the ring 58 which introduces a desired electrical, for example, capacitive characteristic, though it is electrically continuous.

What is claimed is:

1. A signal coupling arrangement comprising:

first and second signal paths between which an unwanted signal has been transferred, wherein the first and second signal paths include respective first and second antenna elements configured with mutually orthogonal polarization properties; and a cross-coupling path including means for compensating for the unwanted signal by transferring a compensating signal from the first signal path to the second signal path.

2. A signal coupling arrangement comprising:

first and second signal paths between which an unwanted signal has been transferred, the first and second signal paths including a patch antenna including first and second antenna elements; and a cross-coupling path, provided between a pair of transmission lines respectively connected to the first and second antenna elements, the cross-coupling path including a four port compensation network;

wherein the four port compensating network constitutes means for compensating for the unwanted signal by transferring a compensating signal from the first signal path to the second signal path.

3. The signal coupling arrangement as claimed in claim 2, wherein:

the compensation network is a microstrip edge coupler network.

4. A signal coupling arrangement for use in an antenna array including antenna elements, the arrangement comprising, between each pair of adjacent antenna elements:

first and second signal paths between which an unwanted signal has been transferred, wherein the first and second signal paths include the respective first and second adjacent antenna elements in the pair; and a compensating cross coupling arrangement, disposed between the first and second signal paths;

wherein the compensating cross coupling arrangement constitutes means for compensating for the unwanted signal by transferring a compensating signal from the first signal path to the second signal path.

5. The signal coupling arrangement as claimed in claim 4, wherein:

the compensating cross coupling arrangement is a microstrip edge coupler.

6. A signal coupling method for compensating for an unwanted signal that has been transferred between first and second signal paths, the method comprising:

transferring a compensating signal on a cross-coupling path from the first signal path to the second signal path, the cross-coupling path characterized by a length; and adjusting the length of the cross-coupling path so that the compensating signal and the unwanted signal are of opposite phase and of equal magnitude, so as to compensate for the unwanted signal.

7. A signal coupling method for compensating for an unwanted signal that has been transferred between first and second signal paths, the method comprising:

providing the first and second signal paths with respective first and second antenna elements configured with mutually orthogonal polarization properties; and compensating for the unwanted signal by transferring a compensating signal from the first signal path to the second signal path via a cross-coupling path.

8. A signal coupling method for compensating for an unwanted signal that has been transferred between first and second signal paths, the method comprising:

providing the first and second signal paths with a patch antenna including first and second antenna elements;

providing a four port compensation network between a pair of transmission lines respectively connected to the first and second antenna elements; and compensating for the unwanted signal by transferring a compensating signal from the first signal path to the second signal path via the four port compensating network.

9. The signal coupling method as claimed in claim 8, wherein:

the compensation network is a microstrip edge coupler network.

10. A signal coupling method for use in an antenna array including antenna elements, the arrangement including, between each pair of adjacent antenna elements, first and second signal paths between which an unwanted signal has been transferred, the method comprising:

providing the first and second signal paths with the respective first and second adjacent antenna elements in the pair; and compensating for the unwanted signal by transferring a compensating signal from the first signal path to the second signal path via a compensating cross coupling arrangement disposed between the first and second signal paths.

11. The signal coupling method as claimed in claim 10, wherein:

the compensating cross coupling arrangement is a microstrip edge coupler.

* * * * *